US011041694B1

(12) United States Patent
Holland

(10) Patent No.: US 11,041,694 B1
(45) Date of Patent: Jun. 22, 2021

(54) QUICK AIM RETICLE

(71) Applicant: Darrell Holland, Powers, OR (US)

(72) Inventor: Darrell Holland, Powers, OR (US)

( * ) Notice: Subject to any disclaimer, the term of this patent is extended or adjusted under 35 U.S.C. 154(b) by 43 days.

(21) Appl. No.: 16/534,843

(22) Filed: Aug. 7, 2019

Related U.S. Application Data

(63) Continuation-in-part of application No. 16/423,978, filed on May 28, 2019, which is a continuation-in-part of application No. 15/950,464, filed on Apr. 11, 2018, now Pat. No. 10,302,395.

(51) Int. Cl.
*F41G 1/38* (2006.01)
*F41G 1/473* (2006.01)

(52) U.S. Cl.
CPC ..... *F41G 1/473* (2013.01); *F41G 1/38* (2013.01)

(58) Field of Classification Search
CPC ... F41G 1/38; F41G 1/473; F41G 3/06; G02B 27/32; G02B 23/14
USPC ..... 42/122, 130; 356/21; 89/41.17
See application file for complete search history.

(56) References Cited

U.S. PATENT DOCUMENTS 1,190,121 A 7/1916 Critchett
3,190,003 A 6/1965 O'Brien
3,392,450 A 7/1968 Herter et al.
3,744,133 A 7/1973 Fukushima et al.
3,782,822 A 1/1974 Spence et al.
3,826,012 A 7/1974 Pachmayr
3,862,012 A 1/1975 Stork
3,948,587 A 4/1976 Rubbert
3,990,155 A 11/1976 Akin et al.
4,263,719 A 4/1981 Murdoch
4,389,791 A 6/1983 Ackerman
5,491,546 A 2/1996 Wascher
5,499,455 A 3/1996 Palmer
5,920,995 A 7/1999 Sammut
5,960,576 A 10/1999 Robinson
6,357,158 B1 3/2002 Smith
6,453,595 B1 9/2002 Sammut
6,516,551 B2 2/2003 Gaber
6,516,699 B2 2/2003 Sammut et al.
6,591,537 B2 7/2003 Smith
6,609,325 B2 8/2003 Harris
6,681,512 B2 1/2004 Sammut
6,729,062 B2 5/2004 Thomas
6,772,550 B1 8/2004 Leatherwood
7,738,082 B1 * 6/2010 Peters ..... F41G 3/02 356/4.01
7,856,750 B2 12/2010 Sammut et al.
7,926,408 B1 * 4/2011 Kley ..... F41G 1/02 89/41.17
8,109,029 B1 2/2012 Sammut et al.
(Continued)

*Primary Examiner* — Michael D David
(74) *Attorney, Agent, or Firm* — Timothy E. Siegel Patent Law, PLLC; Timothy E. Siegel

(57) ABSTRACT

A method of creating a rifle and scope assembly, that begins with selecting and providing a rifle having a caliber and barrel length and providing a selection of rifle scopes, wherein each one is matched to a caliber and barrel length. Then, a rifle scope that matches the caliber and barrel length of the rifle is selected from the selection of rifle scopes. The rifle scope is attached to the rifle. Then, a cartridge type is selected to be used in the rifle. A range to zero the rifle scope is selected, based on caliber, barrel length and cartridge type. The final step is zeroing the rifle scope to the selected range.

8 Claims, 9 Drawing Sheets

(56) References Cited

U.S. PATENT DOCUMENTS

| | | | | |
|---|---|---|---|---|
| 8,230,635 | B2 * | 7/2012 | Sammut | F41G 3/06 42/122 |
| 8,353,454 | B2 * | 1/2013 | Sammut | F41G 3/08 235/404 |
| 8,656,630 | B2 * | 2/2014 | Sammut | F41G 1/38 42/122 |
| 8,910,412 | B2 * | 12/2014 | Mikroulis | F41G 3/06 42/122 |
| 8,959,824 | B2 * | 2/2015 | Sammut | F41G 1/473 42/122 |
| 8,966,806 | B2 | 3/2015 | Sammut et al. | |
| 9,068,799 | B1 * | 6/2015 | Wu | F41G 1/38 |
| 9,297,615 | B2 * | 3/2016 | Meinert | F41G 1/18 |
| 9,335,123 | B2 | 5/2016 | Sammut | |
| 10,302,395 | B1 | 5/2019 | Holland | |
| 2003/0145505 | A1 | 8/2003 | Kenton | |
| 2005/0229468 | A1 | 10/2005 | Zederey | |
| 2012/0046100 | A1 * | 2/2012 | Roman | F41G 1/467 463/30 |
| 2014/0370993 | A1 * | 12/2014 | Roman | F41G 1/467 463/51 |
| 2015/0034722 | A1 * | 2/2015 | Roman | F41G 1/467 235/404 |
| 2015/0233675 | A1 * | 8/2015 | Roman | F41G 3/06 235/407 |
| 2015/0241172 | A1 * | 8/2015 | Roman | F41G 3/165 235/404 |
| 2016/0069643 | A1 * | 3/2016 | Lyren | F41G 3/08 345/589 |
| 2016/0084617 | A1 * | 3/2016 | Lyren | F41G 3/08 42/135 |

* cited by examiner

QUICK AIM RETICLE

RELATED APPLICATIONS

This application is a continuation-in-part of application Ser. No. 16/423,978 filed May 28, 2019, which itself is a continuation-in-part of application Ser. No. 15/950,464, filed Apr. 11, 2018, now U.S. Pat. No. 10,302,395, issued May 28, 2019, which are incorporated by reference as if fully set forth herein.

BACKGROUND

Hunting for deer requires quick decision making. Time required to make calculations can be time that a deer uses to move on to more inviting forage, leaving the hunter's field of view. Accordingly, a system that can be used in a brief moment, and without needing to take one's eye from a scope eyepiece, is advantageous.

Also, increasingly common timed shooting competitions require participants to navigate a course, while shooting at targets, some of which are human shaped. If a participant uses a laser range finder, the time to read the laser range finder and adjust the elevation knob accordingly is time lost in negotiating the course. A faster way of ranging and aiming would provide a competitor with an advantage, in finishing the course quickly. Many shooters use pellet guns, particularly for short range target practice, shooting at, for example vegetable-juice cans, to help improve aim and for a moment's recreation.

Another issue in the ability to rapidly aim and shoot, is directing the rifle's barrel at an upward angle, enough to compensate for bullet drop due to gravity. Different approaches to finding the correct elevation angle include reticle markings that are a uniform angular distance apart and elevation knobs that permit the scope line-of-sight to be pointed down relative to the rifle, according to the turn of the knob. Each of these methods require some calculation to translate from target range to elevation angle that accurately compensates for target range.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a rifle and rifle scope assembly, comprising a rifle, having a caliber; a rifle scope housing, attached to the rifle, the housing defining an eyepiece; and an optical train, in the housing; and a reticle lens, in the optical train. Further, when a user looks through the eyepiece, the reticle lens presents a display having a set of horizontal markings spaced apart so that, for a predetermined cartridge type fitting the caliber of the rifle, with respect to a bullet fired from the cartridge in the rifle at a target at the same elevation as the assembly, a first marking is calibrated so that when the assembly is tilted up so that the marking is aligned to a target at a first known range, the bullet will be at the target elevation at the target range, as the tilt compensates for bullet drop; and a second marking if aligned to a target at a second range will cause the bullet, to be at the target elevation at the second target range; and the third marking if aligned to a target at a third range will cause the bullet to be at the target elevation at the third target range. And further, wherein the third target range is as much greater than the second target range, in units of length, as second target range is from the first target range.

In a second separate aspect, the present invention may take the form of a method for aiming a rifle at a target that uses a rifle scope attached to the rifle and zeroed. The rifle scope includes a housing, defining an eyepiece, an optical train in the housing, and a reticle lens, in the optical train. Further, when a user looks through the eyepiece, the reticle lens presents a display having a set of horizontal markings spaced apart so that, for a predetermined cartridge type fitting the caliber of the rifle, with respect to a bullet fired from the cartridge in the rifle at a target at the same elevation as the assembly, a first one of the markings is calibrated so that when the assembly is tilted up so that the marking is aligned to a target at a first known range, the bullet will be at the target elevation at the target range, as the tilt compensates for bullet drop. In addition, a second one of the markings if aligned to a target at a second range will cause the bullet, to be at the target elevation at the second target range. Also, a third one of the markings if aligned to a target at a third range will cause the bullet to be at the target elevation at the third target range. Further, the first and second range and the second and third range are both separated by a first distance. And further, wherein additional markings correspond to further ranges, also spaced from nearest neighbor markings by the first distance, the markings being labeled in units of range. Returning to the method steps, a range to the target is determined and the user looks through the scope and aligns the marking closest to the determined range, to the target.

In a third separate aspect, the present invention may take the form of a method of creating a rifle and scope assembly, that begins with selecting and providing a rifle having a caliber and barrel length and providing a selection of rifle scopes, wherein each one is matched to a caliber and barrel length. Then, a rifle scope that matches the caliber and barrel length of the rifle is selected from the selection of rifle scopes. The rifle scope is attached to the rifle. Then, a cartridge type is selected to be used in the rifle. A range to zero the rifle scope is selected, based on caliber, barrel length and cartridge type. The final step is zeroing the rifle scope to the selected range.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENTS

Definition: a man of average dimensions or target in the form a silhouette of a man (a "silhouette target"), are henceforth collectively referred to as an "m-target", with references to a "belt," or "head" in the context of a silhouette target, to be interpreted as representing the position on the silhouette target corresponding to the location where a man typically wears a belt, or the head, respectively. It is common for silhouette targets to be used in shooting competitions, including timed shooting competitions and competitions in which a course is navigated while shooting at targets.

Figure 1:
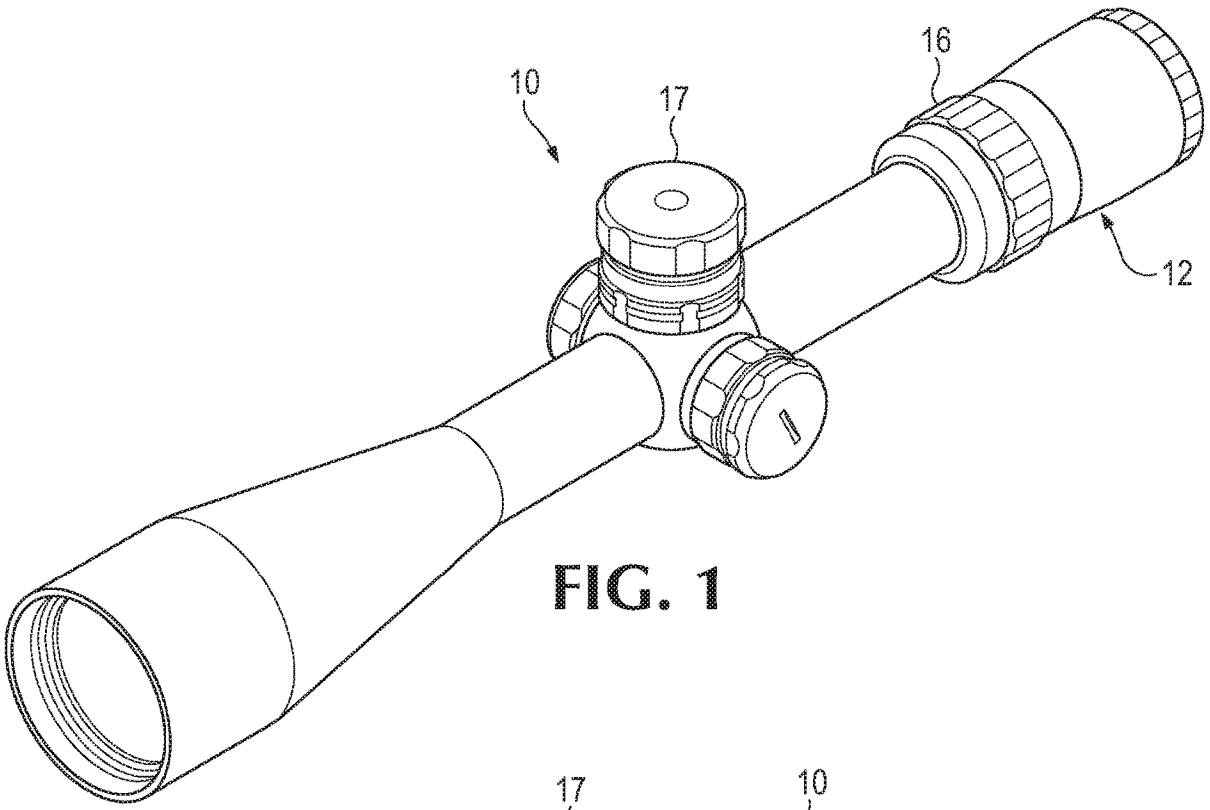
FIG. 1 is an isometric view of a rifle scope according to the present invention.
Figure 2:
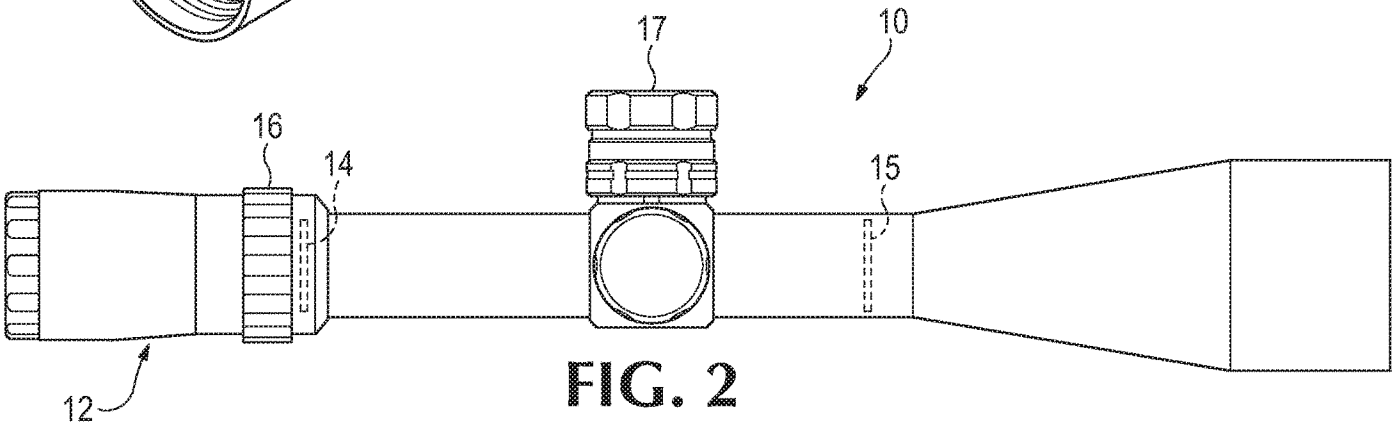
FIG. 2 is a side view of the rifle scope of FIG. 1.

Referring to FIGS. 1 and 2, a rifle scope 10, according to a preferred embodiment of the present invention, includes an eyepiece 12, a reticle lens 14, positioned in the second focal plane, and a zoom selector or power ring 16. In embodiments, scope 10 is attached to a rifle by a well-known method, such as by way of a Picatinny rail, to form a scope and rifle assembly (not shown). In an alternative embodiment the reticle lens is positioned in the first focal plane 15. An elevation knob 17 permits adjustment of the elevation of the reticle marks as seen by a user, versus the actual pointing direction of the scope 10 (and thereby the attached rifle).

Figure 3:
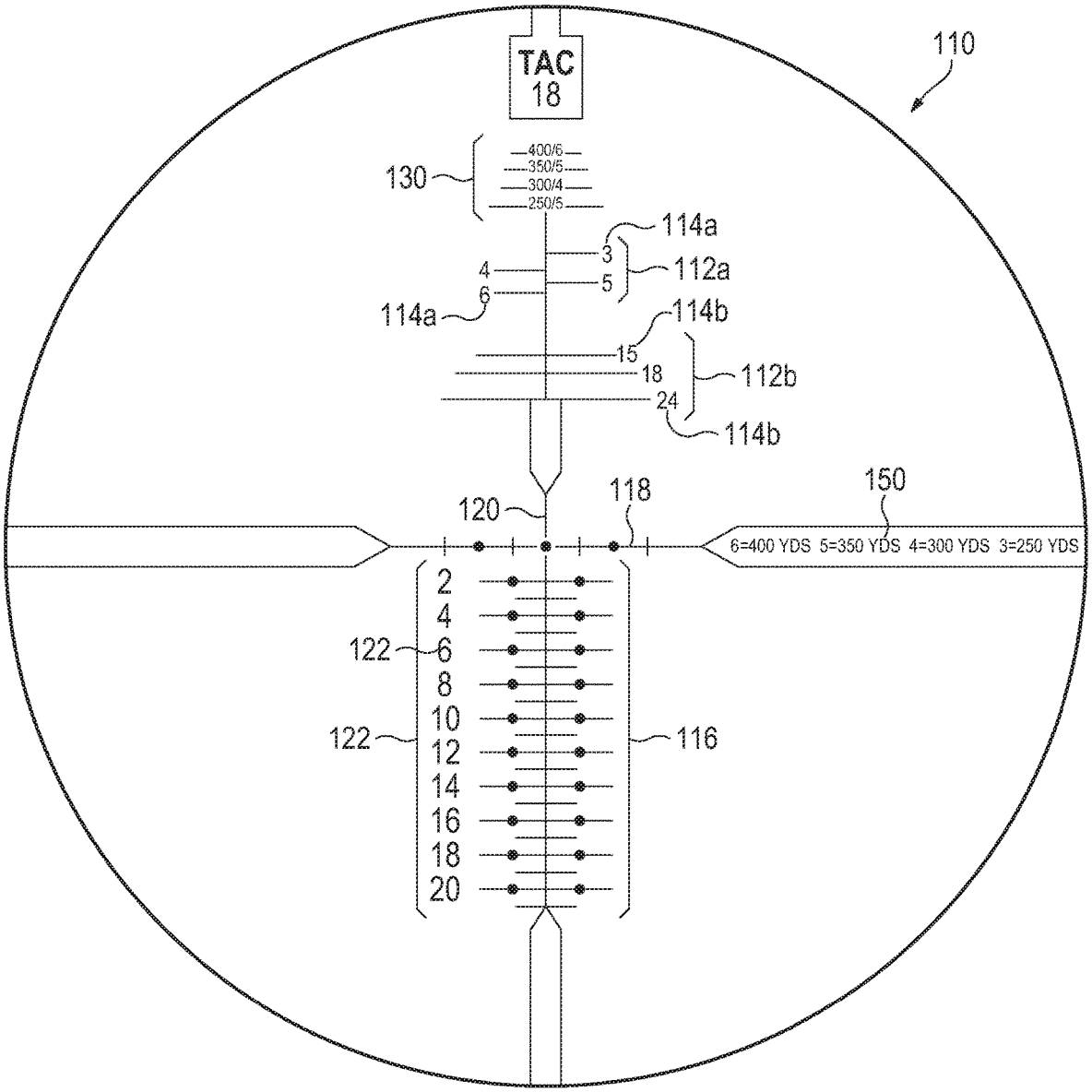
FIG. 3 is a reticle as seen through the scope of FIG. 1.

Referring to FIG. 3, a hunter viewing through the rifle scope 10 (attached to a rifle to form an assembly of rifle and scope) sees the reticle design 110 shown. For the embodiment in which the reticle lens is positioned in the second focal plane, the markings shown correspond to the highest level of scope magnification. The hunter may line up a target of known height, so that it is between, or subtends, a pair of lines, with a first line of the pair selected from a set of first lines 112*a*, and the second line of the pair selected from a set of second lines 112*b*, with both sets situated in the upper portion of the field of view. The set of first lines 112*a* are each marked with an indicium 114*a*, and the set of second lines 112*b* are each marked with an indicium 114*b*.

Figure 4A:
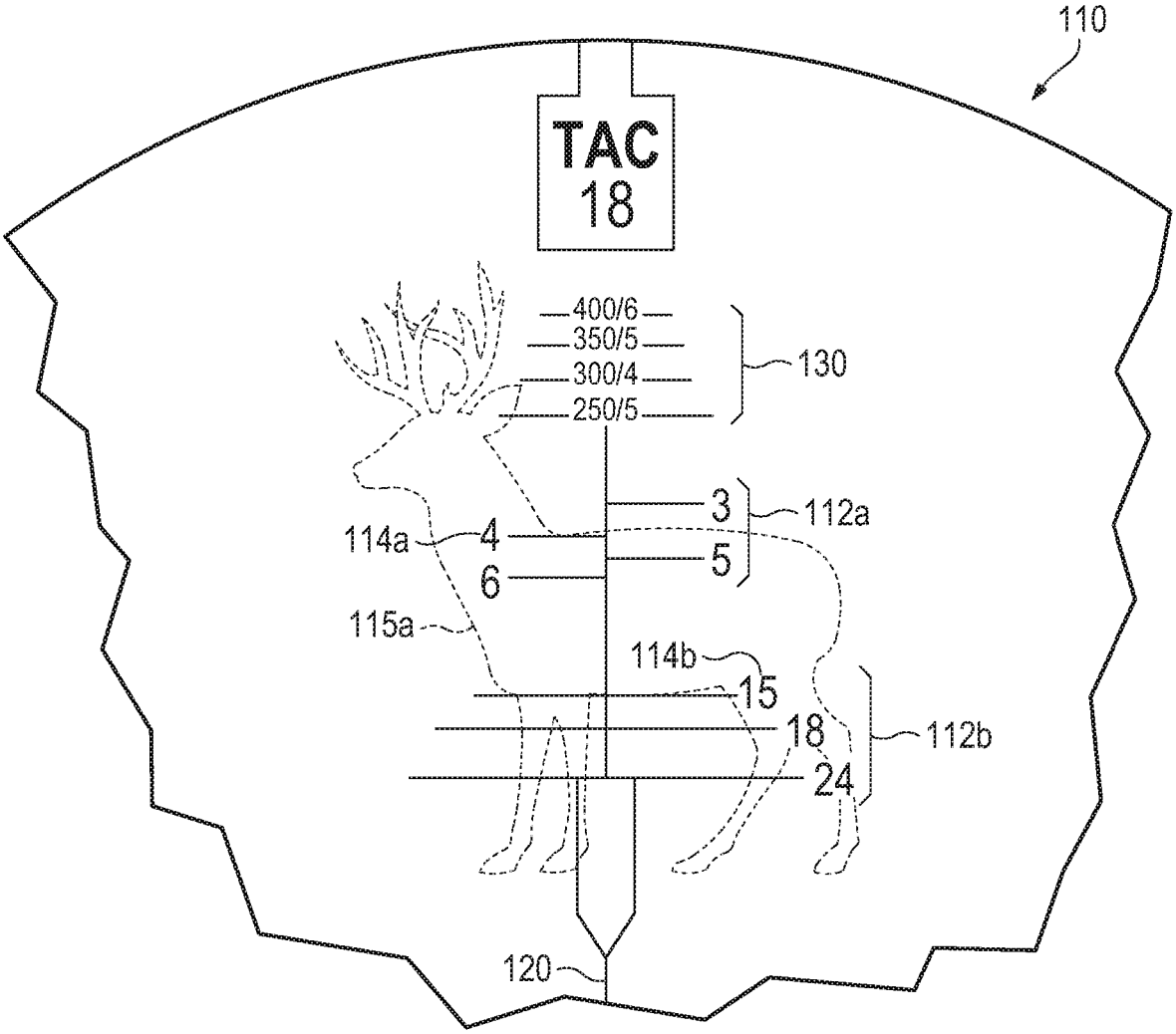
FIG. 4*a* is a view of a black tail buck at 300 yards, on the reticle of FIG. 3.
Figure 4B:
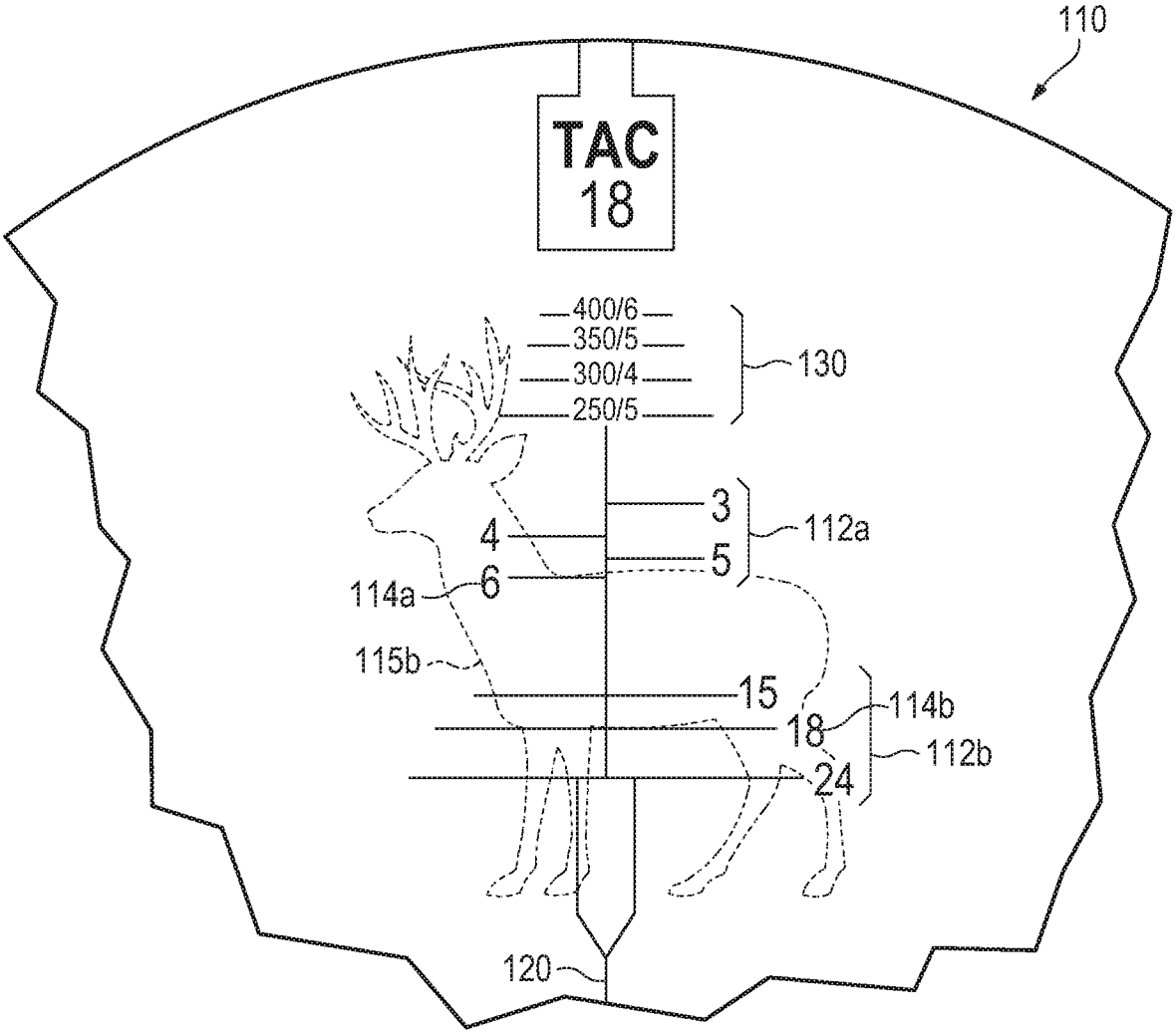
FIG. 4*b* is a view of a mule deer buck at 400 yards, on the reticle of FIG. 3.

In use of the scope 10 having reticle design 110, a shooter chooses a line from the set of second lines 112*b* based on pre-knowledge of the vertical height of the target. For example, it is well known that an adult Black Tail Deer measures 15" from back to brisket (the bottom of the rib cage), as does an Antelope, a Coues Deer and a Texas White Tail Deer. Accordingly, if the shooter were taking aim at one of those creatures, he would choose the second line 112*b* that is marked with a "15" indicium 114*b*. Then, he determines which one of the first lines 112*a* forms a pair with the selected second line 112*b* that brackets the buck from back to brisket (the bottom of the rib cage). FIG. 4*a* shows a Black Tail Buck 115*a* at 300 yards, subtending the pair of lines formed by the line 112*b* marked with a "15" indicium 114*b* and the line 112*a* marked with the "4" indicium 114*a*, indicating that 4 minutes of angle are required to compensate for bullet drop to the target, which is at about 300 yards. In FIG. 4*b* a Mule Deer Buck 115*b* is shown subtending the pair of lines formed by the line 112*b* marked with an "18" indicium 114*b* and the line 112*a* marked with a "6" indicium 114*a*. The indicia 114*a* and 114*b*, each reflect a target measurement made from the top of a second line 112*b* to the bottom of a first line 112*a*, as opposed to a measurement from the center of a second line 112*b* to a center of a first line 112*a*. With this innovation none of the target is blocked by either line 112*a* or 112*b*, both of which have some finite width, which would otherwise introduce uncertainty to the process of fitting a target to a pair of lines.

Notably, the reticle design shown also permits aiming at a mule deer, using a line selected from the second set of lines 112*b*, and marked at "18" by the indicium 114*b*, reflecting the 18" distance from the back of a mule deer to the bottom of the brisket. Similarly, the second lines 112*b* also permit ranging a cow elk, by using the line marked with indicium 114*b* as "24," reflecting the distance in inches from the back to the brisket of an adult cow elk.

Figure 4C:
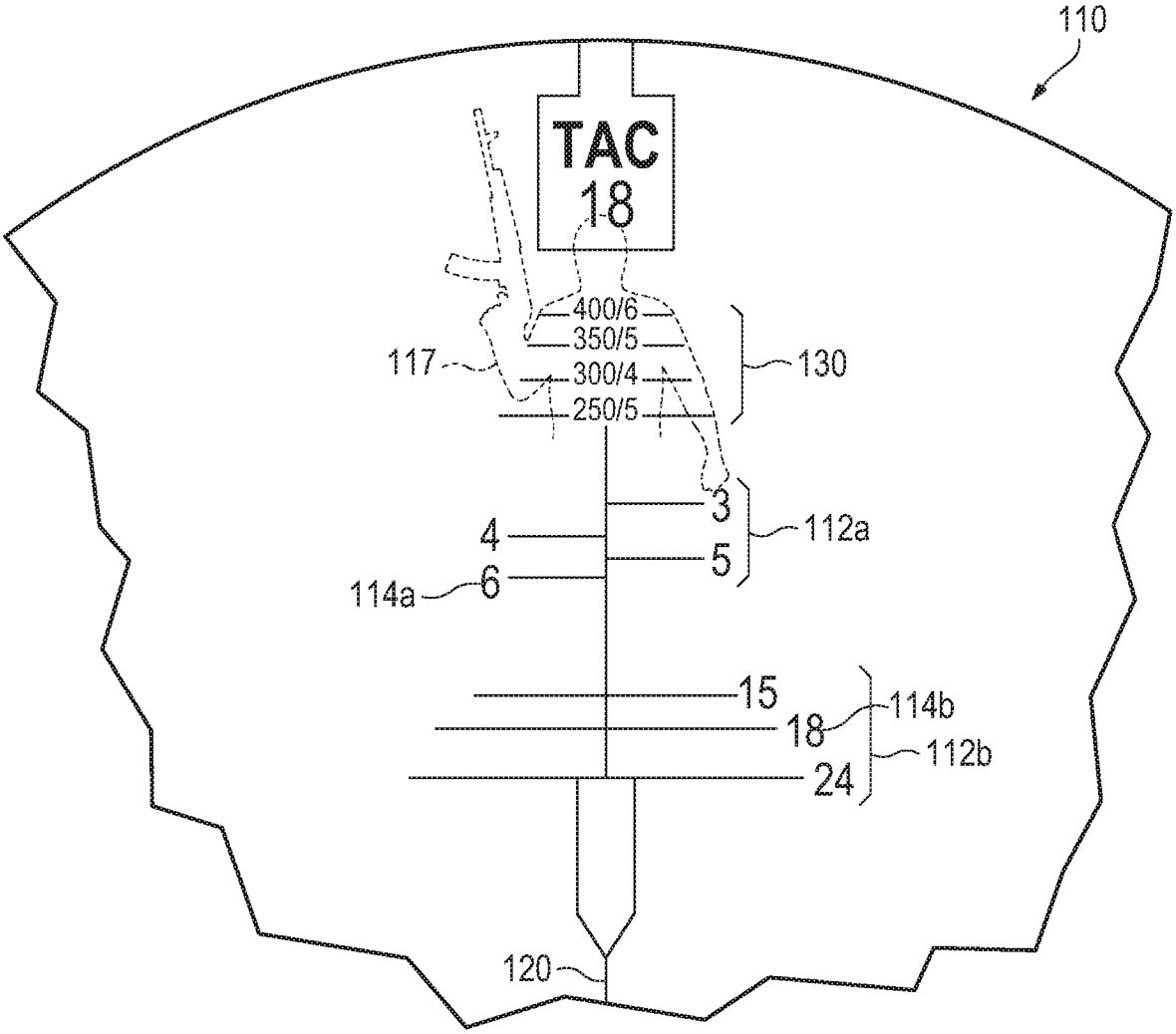
FIG. 4*c* is a view of a human figure at 400 yards.

A set of third lines 130, are provided for quickly measuring the range to a target that is 18" in width, such as an m-target. This is indicated by the "TAC 18" icon at the very top of the reticle pattern. Third lines 130 are each marked by the range in yards to an 18" width target that fits the line width, and the minutes of angle of bullet drop that will occur over that range, in a format of "range/bullet drop". To use lines 130 a shooter determines which line best fits the 18" width target and reads the bullet drop indicium in the middle of the line 130 that best fits the shoulder width. FIG. 4*c* shows lines 130 being used to range an m-target 117. An m-target is typically 18 inches across at the back, with the top line of lines 130 indicating that the figure is at 400 yards.

Figure 4D:
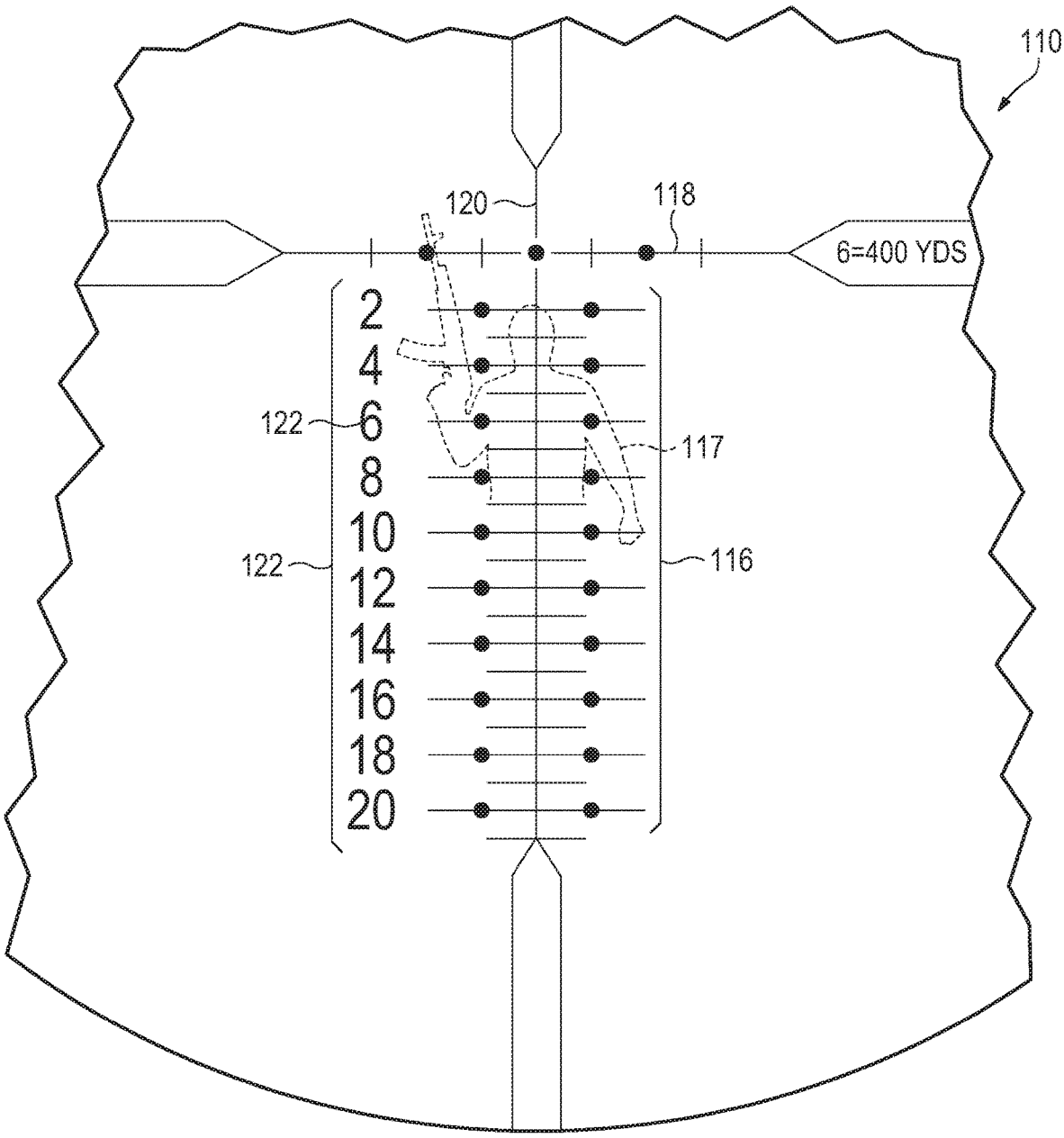
FIG. 4*d* is a view of the reticle aimed at the human figure as informed by the ranging of FIG. 4*c*.

Referring to FIG. 3 and FIG. 4*d*, a set of marks 116, below the horizontal line 118, in the embodiment shown taking the form of a set of lines, crossing a vertical line 120, but which could also be some other shape, and marked with indicia 122, that match indicia 114*a*. So, in the Black Tail Buck example presented above, the shooter places the mark 116 bearing the indicium "4" on the target, thereby lifting a rifle attached to the scope up by 4 minutes of angle, enough to compensate for the bullet drop to the target. In the Mule Deer example, the hunter would place the mark 116 bearing the "6" on the target. FIG. 4*d* shows the reticle being used to aim at the human FIG. 117, with the center of the line 116 that is marked with a "6" by an indicium 122, placed over the heart location of the FIG. 117, as was indicated by the ranging performed in FIG. 4*c*.

Figure 5:
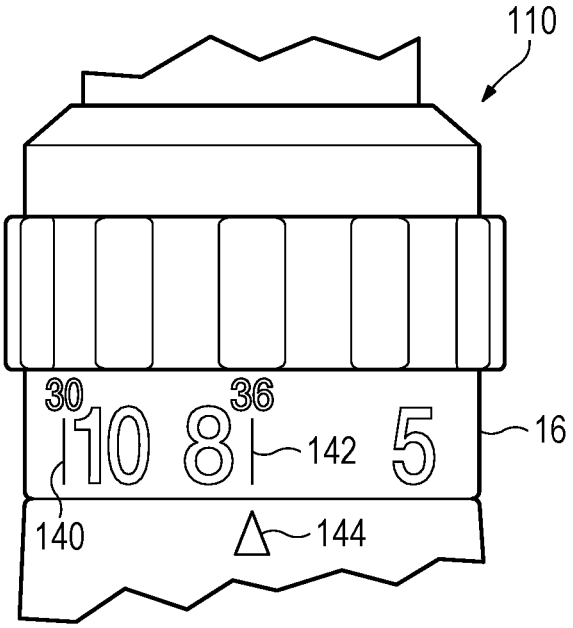
FIG. 5 is an isometric view of the zoom ring of the scope of FIG. 1.

Referring to FIG. 5, zoom selector ring 16 is marked with two marks 140 and 142, as shown "30" and "36," respectively. When the numeral 30 is chosen (the zoom selector ring 16 is moved so that the number is aligned with alignment mark 144, providing a lower level of magnification), and thereby calibrating the line "24" as a "30" or "36" inch target size indicating line. Then the line 112*b* marked with a "24" can be used to range a larger target, that is 30" high. But, if the numeral "36" is chosen, then the line 112*b* marked with a "24" can be used to range targets that are 36" vertically, for example a bull elk, in the same way that the same line can be used to range a cow elk when the zoom selector ring 16 is turned to "24". In the instance of using these lower magnification levels, the indicia of the marks 116 do not reflect the minutes of angle necessary to correct for bullet drop. Some hunters may be knowledgeable enough to correct for the lower magnification level in the use of marks 116. Alternatively, a hunter may turn the zoom selector ring 16 to the highest level of magnification, and then use marks 116, which will accurately compensate for the bullet drop determined in the previous step, or he can use the elevation knob 17 to correct for bullet drop. If the reticle lens 14 is in the first focal plane, zoom adjustments do not affect the spacing of the reticle lines, relative to images in the field of view. The user may use marks 116 to compensate for bullet drop, or the elevation knob 17, informed by the minutes of angle markings of lines 112*a*.

Finally, in an additional feature, a legend 130 permits those using a laser range finder to quickly convert the range provided by the range finder to minutes of angle, which may then guide the usage of marks 116, in the pointing up of a fire arm that is attached to scope 10, to a degree that compensates for bullet drop, to the range of the target.

Generally speaking, a user may alter the position of horizontal line 118 relative to the boresight of the rifle, to compensate for the type of cartridge being used, according to well-known techniques.

Figure 6:
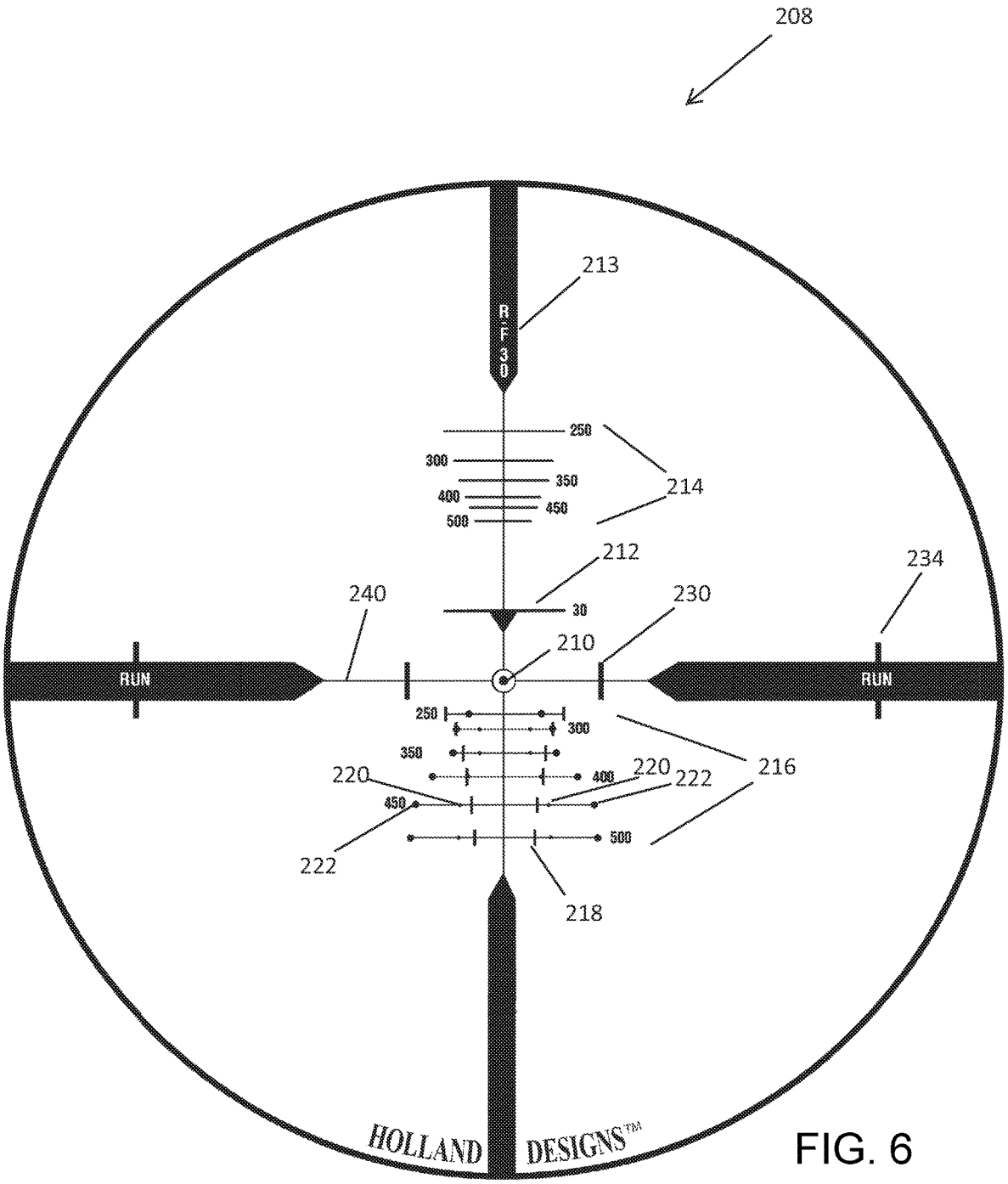
FIG. 6 is an anti-personnel reticle, as seen through a scope.

Referring now to FIG. 6, an anti-personnel reticle 208 is designed for shooting at an m-target. The following discussion applies to the instance where the reticle 208 is placed at the first focal plane, in which case the zoom setting does not affect the proportions of the reticle markings on the field of view, of for a specific zoom magnification level, typically the highest zoom level, if the reticle 208 is placed at the second focal plane. A center point 210 may be aligned relative to the direction of a bullet exiting the barrel of an attached rifle, to compensate for the bullet drop to a target at a range of 100 yards. The user may be advised, by a computer-generated result or a writing listing cartridge types and a zeroing range for each, to align the center point to a different range, for example 125 yards. Alternatively, the user may align the 500-yard mark, to a target at 500 yards. A base line 212, has a numeral "30" beside it to the right, referring to the number of inches from the m-target belt, to the top of its head. This number is also repeated in a marker 213, at the top of the reticle, preceded by the letters "RF" for "range finder." A set of top lines 214, are each accompanied by a numeral to the right. When the base line 212 is aligned to an m-target's belt, the number adjacent the top line 214, when it aligns with the m-target's head-top provides an estimate of the range to the m-target in yards. The width of each line 214 is equal to the 18-inch width of an m-target's shoulders, if the m-target is squarely facing the shooter and is at the range in yards indicated by the numeral adjacent the line 214, as the m-target appears through the scope. A set of aiming lines 216, providing aiming levels corresponding to the range in yards to the target. So that if the target has been ranged at 350 yards, then if the aiming mark 216 adjacent the numeral 350 is placed over the target, the gun barrel will be raised by just enough to compensate for bullet drop.

It is not possible to provide a single reticle having a set of aiming lines, such as aiming lines 216, that can match bullet drop for every type of rifle and cartridge. For a single caliber of rifle, however, the variation in cartridges is substantially more limited than the variation for cartridge characteristics (and the different flight characteristics the cartridges impart to a fired bullet). It is an aspect of this application to disclose a method in which a set of differing rifle scope designs, each one optimized for use with a specific caliber of rifle (or a range of calibers, e.g. . . . .290 to .310 inches), is made available to the public. In a further embodiment, a different scope design is provided for each one of a set of caliber and barrel length pairs (or a range for both of these quantities), based on the variation that these two quantities impart to bullet trajectory, and the fact that these characteristics of a rifle do not change over time, from one shot to the next. Matching to a range may be helpful to encompass calibers and lengths designated in the metric system, that may be very close to an English system of measures in caliber and rifle length. Notably, barrel length provides an indication of the type of ammunition that is likely to be used, as there is little point in using a long barrel rifle with ammunition that does not take advantage of the longer barrel length to achieve a higher muzzle velocity. In another embodiment, the reticle is in the form of a display that can be changed, from showing one set of aiming marks or lines to another. For example, a reticle having a generally transparent liquid crystal display could be constructed so that a multiplicity of sets of aiming marks can be individually turned on, to be displayed, or off. A difficulty, however, may be posed by the shock of rifle recoil, and the effect it would have on a display of this type.

In a method, according to one aspect of the present invention, a user equips his rifle with a scope optimized for its caliber and barrel length. He may then "zero" the scope and rifle assembly at a range that provides the greatest accuracy for the aiming marks 216. The term "zero" in this instance means adjusting the tilt of the scope, relative to the rifle, so that when the center mark 210 of the scope is placed over a target at a prespecified range (typically 100 yards) the elevation angle of the scope will cause the rifle to be pointed up exactly enough to compensate for bullet drop to that range. In one embodiment, an optimum zeroing range chart is provided with the scope, listing different types of ammunition and the ideal range to "zero" the scope to, for that type of ammunition. In this application, the term "zeroed" describes the state of a scope, attached to a rifle after the process of "zeroing" in which the tilt angle of the scope is set so that a bullet fired when positioning the horizontal center line of the scope directly over the target, will exactly compensate for the bullet drop that occurs as the bullet travels 100 yards. The term "zeroed to 250 yards" for example, does not mean that the rifle scope is tilted so that horizontal center line corresponds to the bullet drop to 250 yards, but that the zeroing process is performed at a known range of 250 yards and that the tilt angle is adjusted so that the 250 yard aiming mark, if placed over a target at 250 yard range, will cause the rifle to be pointed up just enough to compensate for the bullet drop to 250 yards. For some types of cartridges this will result in the set of aiming marks more accurately reflecting the ranges listed next to each one.

After purchasing the rifle and the correct scope for the caliber and barrel length, the shooter decides what type of ammunition he will use with that rifle. This may take a few trips to the shooting range, or he or she may have a notion of the ammunition (cartridges) that he will use at the time the rifle is purchased. Because a different cartridge may impart a different muzzle velocity to the bullet, which may encounter a different drag coefficient as it cuts through the air, the aiming marks may not be entirely accurate for every choice of cartridge for the caliber of rifle. But zeroing the scope, and even zeroing to a range that yields optimum accuracy for the cartridge used, can minimize these errors to a workable amount. In any event the amount of time saved by not having to convert range to elevation in units of angle, in many instances, particularly in a timed shooting competition, is adequate compensation for a small amount of inaccuracy, and one that shooters will learn to compensate for, with practice.

Each mark 216 is intersected by a pair of short vertical lines 218, giving the width at the shoulders of an m-target (18 inches), so that if the m-target is squarely facing the shooter, the shooter can find the pair of lines 218 that fit his width at the shoulders, and already have the rifle pointed up enough to just compensate for bullet drop. Small dots 220 are intended to compensate for a cross-wind of 5 mph, whereas large dots 222 are to compensate for a 10 mile an hour wind. Marks 230 and 234 on centerline 240, are to compensate for the movement of a walking or a running target, respectively, between the time a bullet is fired and reaches the range of the target. The word "RUN" on the horizontal center line markings is for a quick reminder to the shooter. Table 1 provides the minute-of-angle differences between the various marks on the reticle pattern 208. One may note that as a bullet travels, it slows down, giving the wind more time to push it off sideways from the boresight. Table 2 provides the minutes of angle below the centerline for each of the lines of the reticle pattern 208.

TABLE 1

Minutes of Angle for Aiming Lines, from Center Line

| Aiming Line (Yds) | Small Dot 5 MPH X-Wind | Large Dot 10 MPH X-Wind | Stadia Bar M-Target Shoulder With |
|---|---|---|---|
| 250 | NA | 2.46 | 3.625 |
| 300 | 1.5 | 3.0 | 3.0 |
| 350 | 1.8 | 3.6 | 2.6 |
| 400 | 2.15 | 4.3 | 2.25 |
| 450 | 2.5 | 5.0 | 2.0 |
| 500 | 2.8 | 5.6 | 1.8 |

TABLE 2

Minutes of Angle Below Center Line

| Aiming Line (Yds) | MOA Below Centerline |
|---|---|
| 250 | 2.1 |
| 300 | 3.3 |
| 350 | 4.7 |
| 400 | 6.3 |
| 450 | 8.0 |
| 500 | 10.0 |

Figure 7:
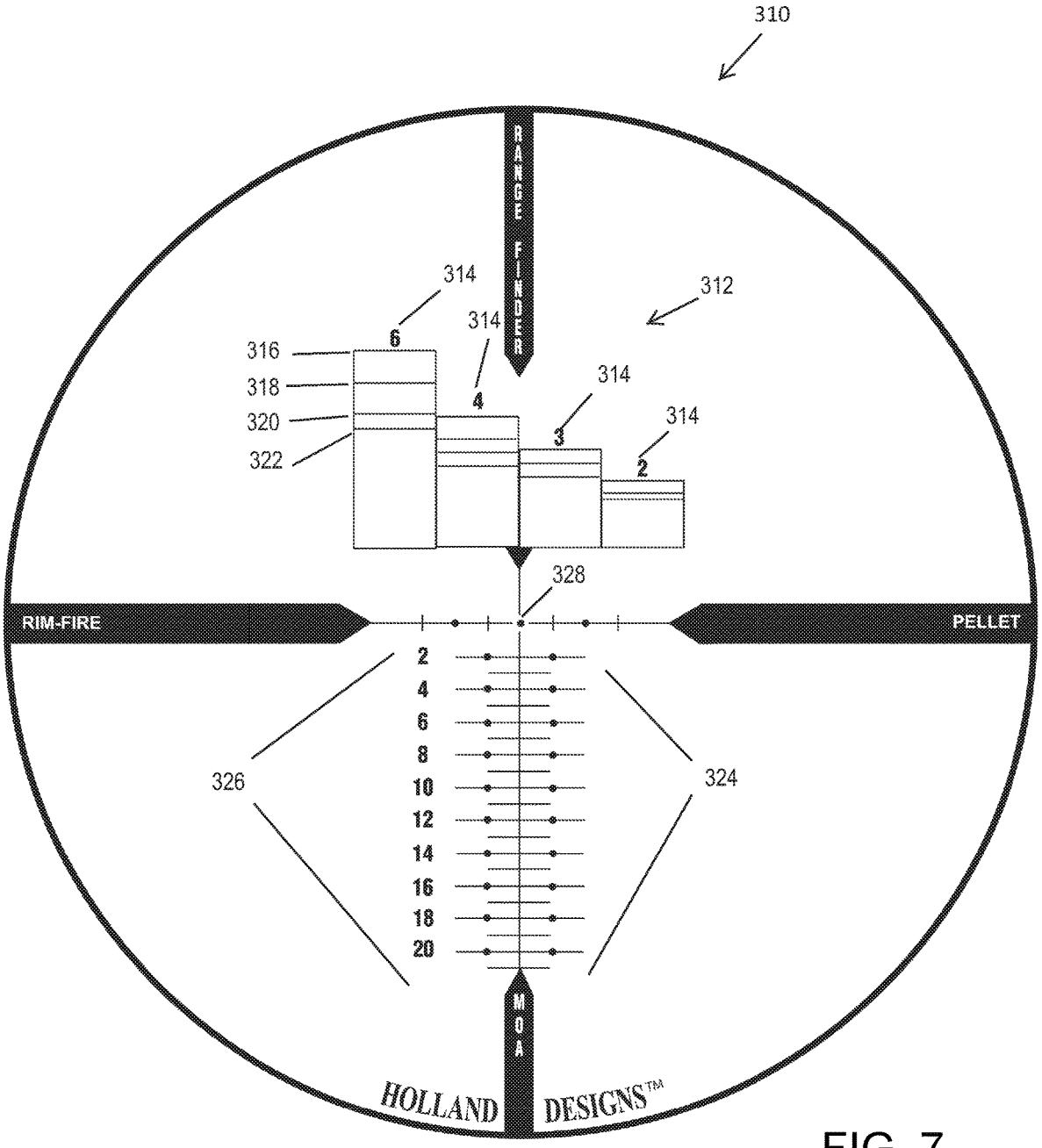
FIG. 7 is a reticle for a pellet gun, as seen through a scope.

Referring now to FIG. 7, a pellet gun reticle 310, which could also be used, for example, when using rim-fire cartridges in a .22" caliber rifle, takes advantage of the fact that in the sort of short-range shooting typically performed with a pellet gun, the shooter is likely engaged in practice with a target of known dimension. The set of vertical bars 312 represents differing target heights, with the numeral 314 atop each vertical bar representing the target height in inches, and the height of the bar 316 corresponds to the vertical reticle-space taken up by a target of that height, if the target is at a range of 50 yards. A line 318, just one down from the top 316 corresponds to a target at 60 yards, a line 320, two down from the top corresponds to a target at 70 yards, and a line 322, three down from the top corresponds to a target at 80 yards. A set of aiming lines 324, are each marked with a numeral 326 giving the minutes of angle that the gun will be pointed up over a center point 328, when the aiming line 324 is aligned with the target. A shooter can determine the range to the target using the appropriate bar 312 (based on his foreknowledge of the target height) and then use that range to calculate the minutes of upward angle needed to compensate for bullet drop, and then use lines 324 to guide him to aim his gun at that upward angle.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A rifle and rifle scope assembly, comprising:

(a) a rifle, having a caliber;

(b) a rifle scope housing, attached to said rifle, said housing defining an eyepiece;

(c) an optical train, in said housing;

(d) a reticle lens, in said optical train;

(e) wherein when a user looks through said eyepiece, said reticle lens presents a display having a set of horizontal markings spaced apart so that, for a predetermined cartridge type fitting said caliber of said rifle, with respect to a bullet fired from said cartridge in said rifle at a target at the same elevation as said assembly, a first said marking is calibrated so that when said assembly is tilted up so that said marking is aligned to a target at a first known range, said bullet will be at said target elevation at said target range, as said tilt compensates for bullet drop; and a said second marking if aligned to a target at a second range will cause said bullet, to be at said target elevation at said second target range; and said third marking if aligned to a target at a third range will cause said bullet to be at said target elevation at said third target range; and (f) wherein said third target range is as much greater than said second target range, in units of length, as second target range is from said first target range.

2. The rifle and scope assembly of claim 1, wherein said ranges are labeled in said units of length.

3. The rifle and scope assembly of claim 1, wherein said units of length are yards.

4. The rifle and scope assembly of claim 1, wherein said second target range is fifty yards greater than said first target range, and said third target range is fifty yards greater than said second target range.

5. The rifle and scope assembly of claim 4, wherein said first target range is 250 yards, said second target range is 300 yards and said third target range is 350 yards.

6. The rifle and scope assembly of claim 5, further having a marking for 100 yards, thereby being separated from said marking for a target range of 250 yards, by 150 yards, and wherein there are no markings between the marking for 100 yards and the marking for 250 yards.

7. The rifle and scope assembly of claim 5, wherein said first mark is labeled with a "250", said second mark is labeled with a "300" and said third mark is labeled with a "350".

8. The rifle and scope assembly of claim 1, wherein said markings on said reticle match a rifle and cartridge type.

* * * * *